US005642885A

United States Patent [19]

Gustin

[11] Patent Number: 5,642,885

[45] Date of Patent: Jul. 1, 1997

[54] CHESS-LIKE GAME

[76] Inventor: John Bruce Gustin, R.R. 1, Box 279, Poughquay, N.Y. 12570

[21] Appl. No.: 677,816

[22] Filed: Jul. 10, 1996

[51] Int. Cl.[6] ..... A63F 3/02

[52] U.S. Cl. ..... 273/261; 273/260

[58] Field of Search ..... 273/261, 260

[56] References Cited

U.S. PATENT DOCUMENTS

| | | | |
|---|---|---|---|
| 4,190,254 | 2/1980 | Leeds | 273/261 |
| 4,211,420 | 7/1980 | Quiroz | 273/260 |
| 4,856,789 | 8/1989 | Carlson | 273/261 |
| 5,257,787 | 11/1993 | Miccio | 273/260 |
| 5,280,913 | 1/1994 | Sirk | 273/261 |

FOREIGN PATENT DOCUMENTS

| | | | |
|---|---|---|---|
| 1189106 | 6/1985 | Canada | 273/260 |
| 2201351 | 1/1988 | United Kingdom | 273/260 |
| WO910781 | 2/1991 | WIPO | 273/260 |

*Primary Examiner*—Benjamin H. Layno
*Attorney, Agent, or Firm*—Schmeiser, Olsen & Watts

[57] ABSTRACT

A chess-type board game including sixty chess-type pieces and a checkered game board of fifteen columns and eight rows. A method for playing the game involving nearly two sets of standard chess pieces on either side, a player needing to capture one of his opponent's kings and checkmate his opponent's second king in order to win the game.

16 Claims, 1 Drawing Sheet

CHESS-LIKE GAME

FIELD OF THE INVENTION

The present invention relates generally to games and methods of playing games, and more specifically to chess-type board games of greater complexity than standard chess with rules similar to those utilized in standard chess.

BACKGROUND OF THE INVENTION

Chess is a classic and popular board game which not only provides fun, but also an intellectual challenge to participants. The wide variety of movements that can be made by chess pieces create a situation where numerous strategies and move combinations can be implemented. The standard chess game consists of a checkered board eight squares across and eight high, and thirty-two pieces divided equally into one set of light colored pieces and one set of dark colored pieces.

One of the great challenges of standard chess is learning to recognize how various pieces may be used separately and in combination. A second challenge involves gaining a sense for which situations and piece placements are strategically advantageous and which are disadvantageous.

Numerous variations of the standard chess game have been proposed both as means of increasing the complexity of the game (e.g., U.S. Pat. No. 4,190,254 to Leeds and U.S. Pat. No. 4,211,420 to Quiroz) and as means of simplifying the game (e.g., U.S. Pat. No. 5,257,787 to Miccio).

While Leeds (U.S. Pat. No. 4,190,254) discloses a chess set utilizing two entire sets of standard chess pieces, that game was designed for use by four players. Thus, in that game, one player only controls one set of standard chess pieces. While the doubling the number of players involved probably does increase the complexity of the game, each player still needs only to keep track of one set of 16 pieces. However, because this game involves four players, it distorts the normal adversarial relationship of standard chess. Players may find themselves forming alliances with other players, or having opposing players forming alliances against them. Furthermore, normal strategy, which involves occasional trading of equivalent pieces, or sacrificing of less valuable pieces to capture more valuable ones is distorted because players trading equivalent pieces may find themselves in weaker positions in relation to the other players.

Quiroz (U.S. Pat. No. 4,211,420) discloses a chess-like board game employing 62 game pieces rather than the standard 32. However, fourteen of those pieces are "boat" pieces, which are completely foreign to standard chess. Furthermore, the board contains a number of squares designated as "water" on which the standard chess pieces may move only if they do so in conjunction with a "boat" piece. This game therefor, departs so far from standard chess so as to render the strategies employed in it almost irrelevant with regard to improving one's chess abilities.

U.S. Pat. No. 5,257,787 to Miccio discloses a chess-like game played on a board containing 30 squares in a five wide and six long configuration. Each player controls 10 standard chess pieces.

Thus, the Miccio game assists inexperienced players to learn basic strategy by minimizing the complexities of the game while preserving the basic rules and context of standard chess. While this is certainly helpful to beginners, it fails to present the expert with even an equivalent challenge to standard chess.

These other chess-type games either alter the rules of chess so much as to render the game almost irrelevant to improving chess abilities, or they simplify the rules in an effort to accommodate beginners. In neither type of game do the participants get both increased complexity and relevance to standard chess strategies, thus allowing participants to improve their chess abilities while enjoying a unique variation of the standard game. The aforementioned prior art, along with the rules of chess, is hereby incorporated by reference.

SUMMARY OF THE INVENTION

The present invention provides a chess-type game involving a checkered board which is eight squares by fifteen squares rather than the standard eight squares by eight squares. It also utilizes sixty pieces rather than thirty-two.

Each player has thirty pieces. These pieces include two kings, two queens, four bishops, four knights, three rooks, and fifteen pawns.

The pieces are set up on the game board in essentially the same manner as in a standard chess game. Thus, on the first row of fifteen squares, in left to right order, a player sets up a rook, a knight, a bishop, a queen, a king, a bishop, a knight, a rook, a knight, a bishop, a king, a queen, a bishop, a knight, and a rook. On the second row of fifteen squares, the player sets up fifteen pawns. The other player sets up the other color of pieces in similar fashion on rows eight and seven.

The players then alternate turns, utilizing chess rules for movement and capture of pieces. The game continues in this manner until a player captures one of his opponent's kings and checkmates the other one.

Because of the additional pieces and the increased number of spaces on the board in relation to classical chess, players are faced with many more possible combinations of moves and piece positions. This increase of available choices affords players an opportunity to greatly expand their strategic abilities for standard chess.

Furthermore, this game allows players to utilize their kings more fully because until one of a player's kings has been captured, that player need not move either king out of a checked position. This teaches players additional possible strategic utilizations of the king piece.

It is therefore an advantage of the present invention to provide a training tool whereby advanced chess players may improve their abilities in standard chess while enjoying a unique variation of the game.

It is therefore a further advantage of the present invention to provide a game that may be played in a tournament setting.

It is therefore a further advantage of the present invention to provide a more challenging method of playing a chess-like game.

It is therefore a further advantage of the present invention to increase the number of pieces controlled by a player while incorporating enough of the elements of standard chess to retain relevance to skills necessary to that game.

It is therefore a further advantage of the present invention to increase the complexity of a chess-like game while maintaining the adversarial relationship that is essential to standard chess strategies.

It is therefore a further advantage of the present invention to provide a means for strengthening chess muscles in method similar to the manner in which a baseball player puts weighted rings on a bat. However, unlike the weighted bat, using this invention provides permenant, rather than temporary, improvement in ability and skill.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENTS

Figure 1:
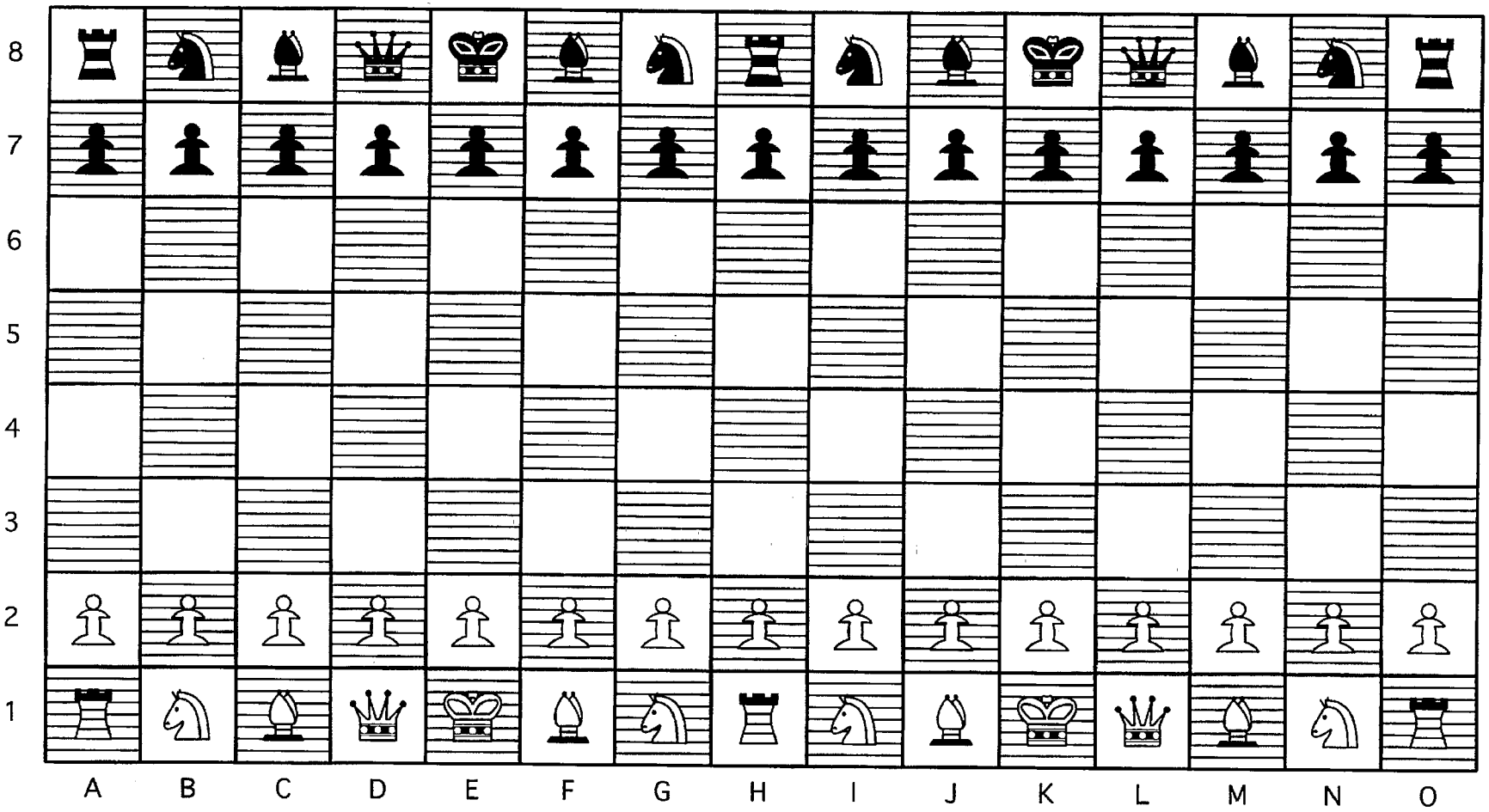
FIG. 1 is a top view of the game board and pieces as they should be properly set up prior to beginning play.

Referring to FIG. 1, there is illustrated a chess-type board game, in accordance with the preferred embodiment of the present invention.

Referring to FIG. 1, the game board is shown, with rows 1–8 and columns A–O forming a checkered grid pattern. The proper initial set-up of the game pieces is shown. All of one color of pieces are initially positioned on row 1 and row 2, and all of a second color of pieces are initially positioned on row 7 and row 8.

The pawns of the respective colors are positioned on rows 2 and 7. The remainder of the pieces of one color are positioned on the following squares: rook A-1, knight B-1, bishop C-1, king D-1, queen E-1, bishop F-1, knight G-1, rook H-1, knight I-1, bishop J-1, queen K-1, king L-1, bishop M-1, knight N-1, and rook O-1. The remainder of the pieces of the other color will be placed on the following squares: rook A-8, knight B-8, bishop C-8, king D-8, queen E-8, bishop F-8, knight G-8, rook H-8, knight I-8, bishop J-8, queen K-8, king L-8, bishop M-8, knight N-8, and rook O-8.

It should be noted that in the preferred embodiment of this invention, the outer most rooks for each player should sit upon a square of an opposite color. For example, with reference to FIG. 1, the dark rooks at A-8 and O-8 should be on light-colored squares, while the light rooks at A-1 and O-1 should be on dark-colored squares. This positioning creates a scenerio wherein each queen, at the start of play, is in the same diagonal as one of the opponent's kings. (E.g., the dark colored queen at L-8 is in the same diagonal as the light colored king at E-1 thereby creating an immediate threat.) One result of this set-up is that it places a great deal of importance on the squares at and near H-4 and H-5 at the start of the game (which can be used to block the queen's attack). Because initial attention is forced to the center of the game board (much like traditional chess), the game has a flow that is unparalleled by other chess-like games.

In describing play of this game, it is assumed that the reader has a basic understanding of the traditional rules of chess. Following initial set-up of the game pieces, one player commences the game by moving one of his pieces in accordance with standard rules of chess. The second player then follows, moving one of his pieces. Players continue moving their pieces, alternating turns in this manner with each piece being moved in a manner compliant with standard chess rules.

In accordance with standard chess rules, queens and rooks may move horizontally the entire length of the board so long as no pieces are positioned in their paths. This introduces a slight variation on standard chess because in standard chess there are only eight horizontal spaces wherein to move, whereas in the present invention there are fifteen horizontal spaces.

Pawns, bishops, and knights move in exactly the same fashion as in standard chess. The only variation from chess here is in the number of these pieces on the board and the increase in possible spaces on which to move.

Pieces are captured and removed from the board in the same fashion as in standard chess. A player may capture his opponent's pieces by moving any of his pieces onto a square occupied by any of his opponent's pieces, and then removing his opponent's piece from the board.

This method of capturing applies to all pieces except the "checkmate" king. Because play ends when this king is checkmated, this piece may never be captured.

The movements of the kings are unique to this game. As stated above, each player has two kings, referred to as the "keystone" king and the "checkmate" king. Although the kings are not predesignated as "keystone" and "checkmate" kings, they assume such designations when the first of a player's kings is captured. At this time, the captured king is designated as the "keystone" king, and the remaining king is designated as the "checkmate" king.

As long as a player has both kings on the board, the player may move the kings into a checked position, or leave them in a checked position. The strategic value of such a rule is that a player may sacrifice the "keystone" king just like any other piece. Thus, a player with both kings on the board may have either king stand face to face with any attacking piece.

However, as soon as the "keystone" king is captured, the "checkmate" king assumes the role of a king as known under the traditional rules of chess. At this time the player no longer has the option of moving his "checkmate" king into check or leaving it in check. Thus, the game ends when a player first captures his opponent's "keystone" king and subsequently checkmates his opponent's "checkmate" king.

Any variation of regular chess may be incorporated into the present invention. Furthermore, the present invention may also be implemented by means of software applications allowing two players or one player versus the computer. The present invention may also be implemented for play on a computer network.

The foregoing description of the preferred embodiments of this invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

What is claimed is:

1. A board game comprising:

a rectangular game board having a playing surface divided into a grid of squares consisting of 120 equally sized squares, said squares being arranged fifteen left to right and eight top to bottom, and alternating in color to form a checkered pattern; and a plurality of game pieces consisting of sixty game pieces which may be placed on said equally sized squares.

2. The board game of claim 1, wherein said sixty game pieces include two sets of player pieces, each set of player pieces including:

two kings;

two queens;

three rooks;

four bishops;

four knights; and, fifteen pawns.

3. The board game of claim 2, wherein a first set of said two sets of player pieces is light colored.

4. The board game of claim 3, wherein a second set of said two sets of player pieces is dark colored.

5. The board game of claim 4, wherein said game board is implemented via software.

6. A method of playing a board game having a board arranged with eight rows of fifteen squares, comprising the steps of:

placing game pieces of a first color on the first row of said board in an order from left to right to include a first rook, a first knight, a first bishop, a first king, a first queen of said first color, a second bishop, a second knight of said first color, a second rook, a third knight of said first color, a third bishop, a second queen, a second king, a fourth bishop of said first color, a fourth knight, and a third rook;

placing said game pieces of said first color on the second row of said board to include fifteen pawns;

placing game pieces of a second color on the eighth row of said board to mirror those pieces placed upon said first row;

placing said game pieces of said second color on the seventh row of said board to include fifteen pawns;

associating a first player with said game pieces of said first color; and associating a second player with said game pieces of a second color said first and second player moving said game pieces in a substantially traditional chess-like fashion.

7. The method of claim 6 wherein said step of moving said game pieces in a substantially traditional chess-like fashion includes the ability to capture one of an opponent's kings.

8. The method of claim 7, wherein said board game continues until a player captures one of his opponent's kings and puts his opponent's remaining king in checkmate.

9. The method of claim 6, wherein said squares on said board are of a checkerboard pattern comprising said first and second color and wherein said first and third rook of said first colored pieces are on squares of said second color.

10. A method of playing a board game for play by two players and having a board arranged with eight rows of fifteen squares, comprising the steps of:

placing game pieces of a first color on the first row of said board in an order from left to right to include a first rook, a first knight, a first bishop, a first king, a first queen of said first color, a second bishop, a second knight of said first color, a second rook, a third knight of said first color, a third bishop, a second queen, a second king, a fourth bishop of said first color, a fourth knight, and a third rook;

placing said game pieces of said first color on the second row of said board to include fifteen pawns;

placing game pieces of a second color on the eighth row of said board to mirror those pieces of a first color placed upon said first row;

placing said game pieces of said second color on the seventh row of said board to include fifteen pawns;

alternating moves between the two players in a chess-like manner; and continuing play until a first player captures an opponent's "keystone" king and checkmates the opponent's "checkmate" king to end the game.

11. The method of claim 10, wherein each move comprises moving one player piece one time according to the rules of standard chess.

12. The method of claim 11, wherein a player may, until one king is captured, move either of his two kings into check and need not move either king out of check.

13. The method of claim 12, wherein once said player's "keystone" king is captured, said player may not move his "checkmate" king into check and must move his second king out of check.

14. The method of claim 12, wherein said "keystone" king may be captured in the same manner as any other piece is captured.

15. The method of claim 14, wherein one of the players is implemented via software.

16. The method of claim 15, wherein both players play the game on a computer network.

* * * * *